United States Patent [19]

Fredriksson

[11] 3,942,729

[45] Mar. 9, 1976

[54] DEVICE FOR SUPPLYING TREATMENT AGENT TO LIGNO-CELLULOSE CONTAINING MATERIAL

[75] Inventor: Borje Ingemar Fredriksson, Matfors, Sweden

[73] Assignee: SCA Projekt Aktiebolag, Matfors, Sweden

[22] Filed: Sept. 5, 1973

[21] Appl. No.: 394,488

[30] Foreign Application Priority Data

Sept. 18, 1972 Sweden ..... 12014/72

[52] U.S. Cl. ..... 241/38; 241/67; 241/250

[51] Int. Cl. ..... B02c 7/06

[58] Field of Search ..... 241/38, 41, 67, 244, 245, 241/250, 251

[56] References Cited

UNITED STATES PATENTS

| | | | |
|---|---|---|---|
| 1,685,115 | 9/1928 | Adams | 241/41 |
| 1,795,603 | 3/1931 | Hussey | 241/251 X |
| 3,685,747 | 8/1972 | Horstman | 241/41 |
| 3,790,092 | 2/1974 | Reinhall | 241/244 |

*Primary Examiner*—Granville Y. Custer, Jr.

*Attorney, Agent, or Firm*—Pierce, Scheffler & Parker

[57] ABSTRACT

Meterial to be ground, such as ligno-cellulose containing material, is fed-in centrally between a pair of juxtaposed relatively rotatable discs. The material being ground moves outwardly towards a discharge point adjacent the periphery of the discs, and a fluidized treatment agent is supplied to the material as it is discharged from between the discs, the treatment agent issuing from an array of circumferentially spaced nozzles which surround the periphery of the discs.

2 Claims, 3 Drawing Figures

DEVICE FOR SUPPLYING TREATMENT AGENT TO LIGNO-CELLULOSE CONTAINING MATERIAL

Figure 1:
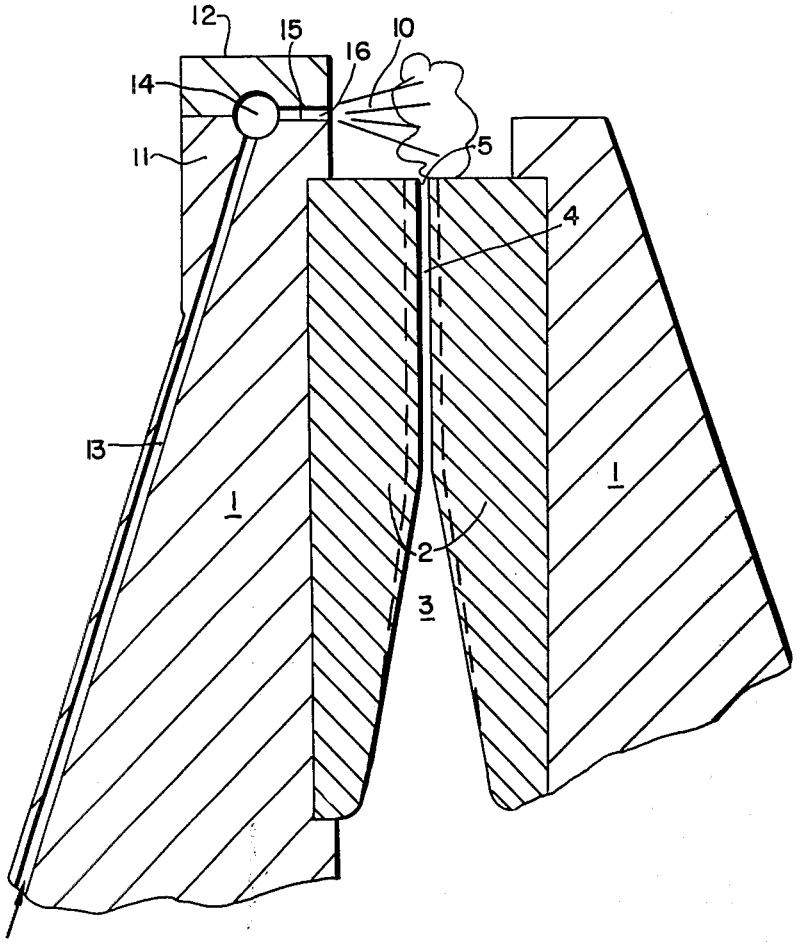

This invention relates to a grinding apparatus comprising a housing, in which a pair of grinding discs are supported adjacent and directly in front of each other of which discs at least one is rotatable and the surfaces of the discs facing each other are capable of grinding material, such as lignocellulosic material, which material is supplied substantially at the centre of the discs and moves outwards from within the space between the grinding discs from which it egresses into the surrounding housing.

Known grinding apparatus of the aforesaid kind does not include possibilities of treating the grinding product immediately after its passage between the grinding discs, before certain ageing effects and/or temperature fluctuations could affect the produce. In the defibration of, for example, wood in grinding apparatus, it is known that the mechanically treated fibers, immediately after the working has stopped, show a great number of free bonds of a short duration. The high accessibility of the fibers to, for example, chemical treatment in the moment after the grinding has stopped cannot be utilized effeciently in known grinding apparatus.

It is known that in the defibration of, for example, wood in grinding apparatus, an increase in temperature and pressure up to a certain level in the treatment zone favorably affects the defibration process in such a manner, that the fibers in the pulp have a greater average length and the pulp does not include as many undefibrated wood particles as a pulp produced at a lower temperature and lower pressure. In an open grinding apparatus of known type treatment temperatures of the range 100°–120°C are obtained. In certain known grinding apparatus the treatment temperatures obtained are still higher, due to the fact that the grinding discs are included in a pressure chamber. The aforedescribed types of known grinding apparatus have one disadvantage in common, viz. that the grinding product is maintained at high temperature for some time after the treatment between the grinding discs has stopped, which implies that the defibrated wood material then is affected for an unnecessarily long time by the heat and is discolored. When the grinding product has a high solids content, the temperature increase to which it is subjected during treatment between the grinding discs in known refiners can be so high, that the treatment is disturbed by an intensive steam formation in the grinding zone. In order to prevent this intensive steam formation, cold water is supplied to the material to be ground prior to the treatment between the grinding discs. The material to be ground is thereby cooled, and its solids content decreases. The cooling as well as the decrease in solids content have a negative effect on the quality of the pulp after the grinding.

The present invention has as its object to render possible the supply of liquid or gas, under given and controlled conditions with respect to temperature, content of chemicals etc., to the grinding product immediately after the treatment between the grinding surfaces. By the possibility of adding, for example, chemicals when the fibre material is most accessible to chemical reactions, the efficiency of a certain treatment can be improved, compared with known methods. By supplying cooling water it is possible to adjust the temperature of the grinding products immediately after the grinding has stopped and thereby to reduce the decrease in brightness.

A further object is to be able to cool the grinding zone by the treating agent and thereby to render possible grinding at consistencies higher than normal. The cooling of the grinding zone is effected by directing the cold treating agent into the space between the grinding discs, before the agent is injected against the pulp flow at the end of the grinding zone. The pulp and the treating agent, thus, do not come into contact with each other during the treatment in the grinding zone. The grinding thereby can be carried out under optimum conditions at a high consistency and without disturbing steam formation.

The aforesaid and other objects are achieved in that the grinding apparatus according to the invention is given the characterizing features defined in the appended claims.

Figure 2:
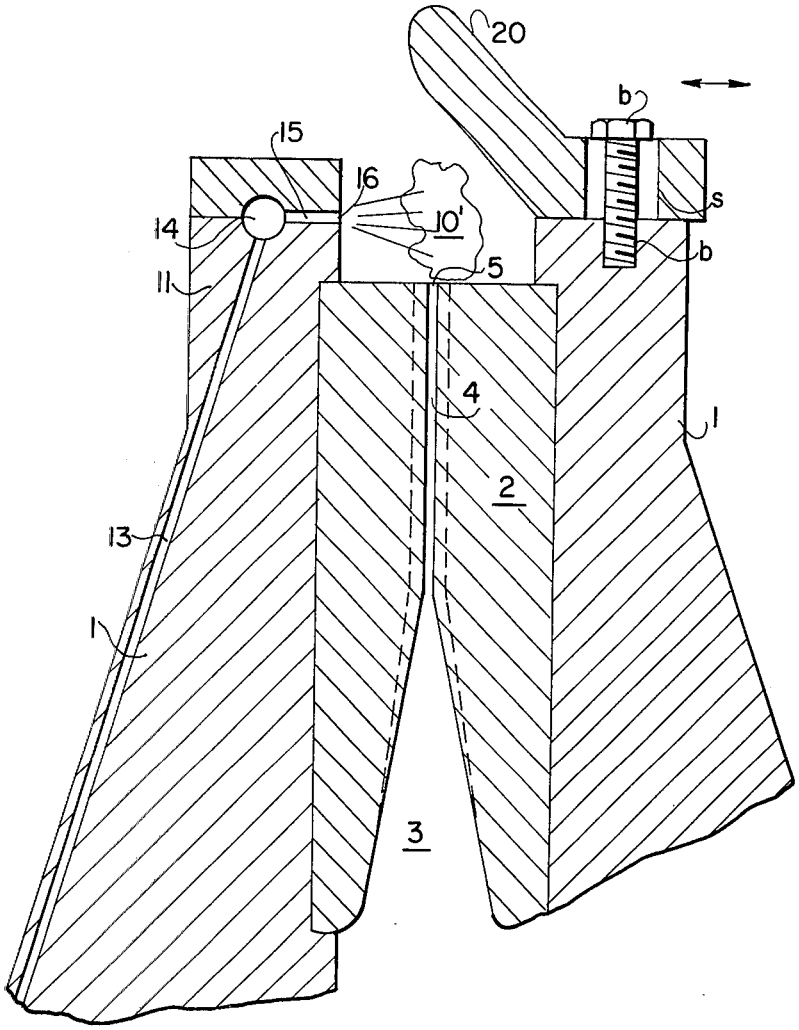
Figure 3:
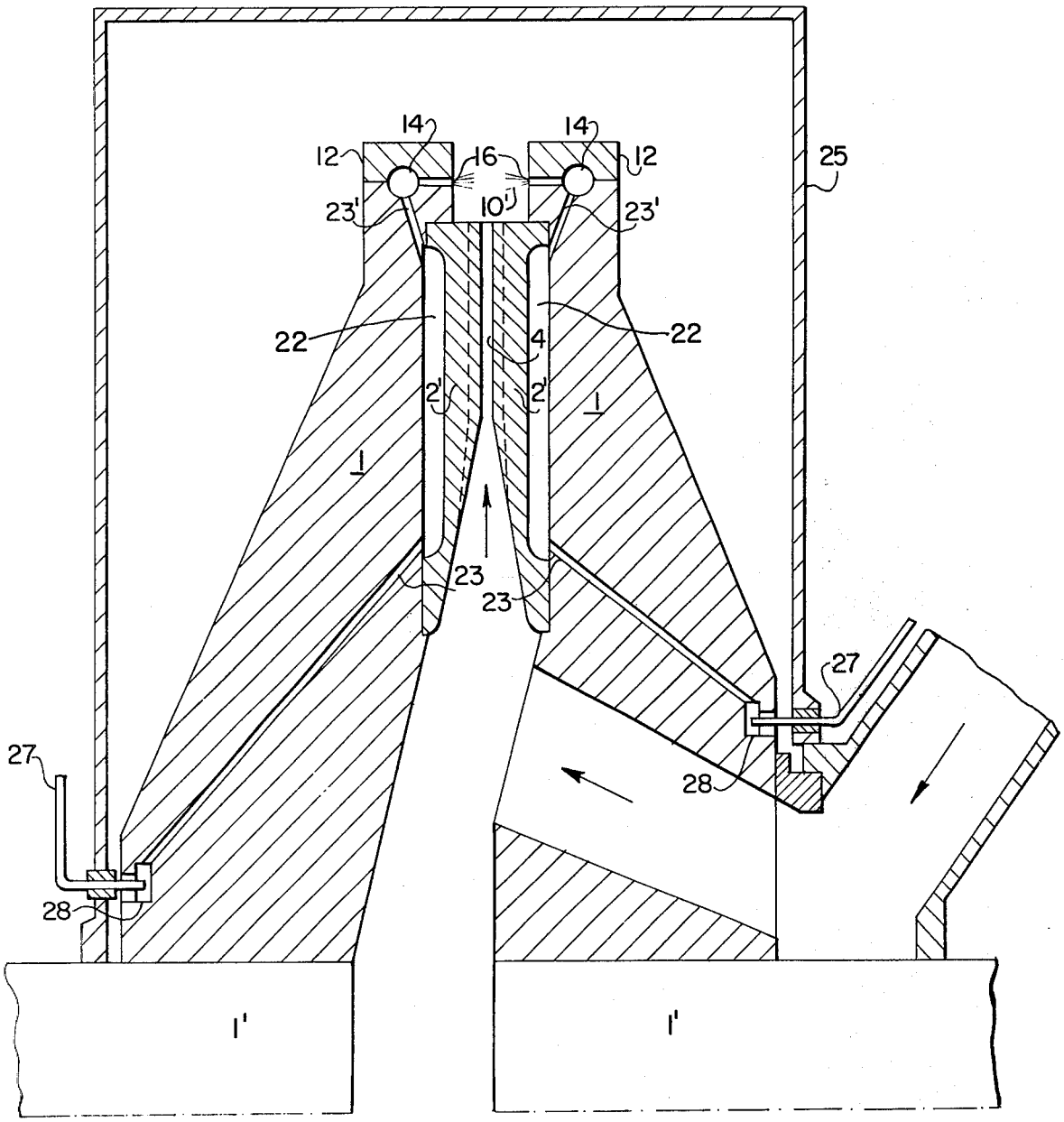

Some constructional embodiments of the invention are described in detail in the following, with reference to the drawings, in which FIG. 1 is a partial sectional view through the outer portion of the grinding discs of a grinding apparatus, showing one embodiment of a device for separate supply of treating agent;

FIG. 2 is a similar partial sectional view, showing a different form of device for the same purpose; and FIG. 3 is a vertical cross-sectional view of of the upper half of a housing for the grinding apparatus and shows an embodiment according to which the treating agent is made to cool grinding plates before being jetted against exiting flow of ground material from between a pair of grinding discs.

FIG. 1 shows an embodiment where the treating agent is directed via the grinding disc of the grinding apparatus. This embodiment requires the grinding disc be drilled out and a turnedout ring be laid around the grinding disc so that a passageway about the periphery of the disc is formed. The treating agent is led from this passageway via a narrow gap or a series of holes or nozzles against the grinding product when it is leaving the grinding gap.

By mounting a ring of suitable shape on the opposed disc, the device for separate supply of the treating agent can be completed by an adjustable flow restriction according to FIG. 2. To effect this relationship the upper extremity of said disc is tapped to receive a bolt "b" while flow restrictor 20 is provided with an elongated slot "s" to receive bolt "b". Adjustment of restrictor 20 toward or away from nozzle 16, as indicated by the arrows, is made by releasing bolt "b", adjusting 20 with respect to 16, and tightening bolt "b".

FIG. 3 shows an example of an embodiment where the treating agent is used as cooling agent for the grinding zone prior to its supply to the grinding product after completed grinding.

In FIG. 1 there are shown portions of a pair of grinding discs 1, 1 which are faced with grinding surfaces in the form of grinding plates 2, 2. One of the discs is driven in conventional manner (driving mechanism not shown). Material to be ground is fed to the space 3 between the grinding discs and moves outwardly through the gap 4 between the grinding surfaces exiting at 5. In the figure there is indicated a cap piece 12, in association with one of the discs 1, in which disc there has been developed a passageway 13 leading to a manifold space 14 from which a plurality of passageways 15 lead to nozzles 16 adapted to direct a flow 10 of treating agent perpendicularly to the flow direction of exiting ground product.

This combination can be further improved, according to the illustration in FIG. 2 by adjustably mounting a flow restriction member 20 on the disc 1 opposite that on which manifold space 14 is provided. To effect this relationship the upper extremity of said disc is tapped to receive a bolt "b", while flow restrictor 20 is provided with an elongated slot "s" to receive bolt "b". Adjustment of restrictor 20 toward or away from nozzle 16, as indicated by the arrows, is made by releasing bolt "b", adjusting 20 with respect to 16, and tightening bolt "b".

According to FIG. 3, the grinding plates 2′, 2′, are so configured as to provide in association with discs 1′, 1′, open spaces 22, 22 on either side of the grinding parts. Treating agent (cold) is fed to spaces 22, 22 through passageways 23, 23, and from spaces 22, 22 via passageways 23′, 23′, to a pair of manifold spaces 14, 14 equipped as shown in FIG. 1. Thereby a flow of treating agent serves to cool the grinding plates before being jetted against the exiting flow of ground material.

As shown in FIG. 3, the drawing shows a vertical cross-sectional view of the upper half of a grinding disc housing of a grinding apparatus. From a tank (not shown) the treating agent flows through a feed pipe 27. A pump means (not shown) for controlling the flow might be inserted in the feed pipe 27. The feed pipe 27 extends into an annular groove 28 in the grinding disc 1. Said groove 28 communicates with a passageway 23, 23′ which extends outwards in the grinding disc 1 up to the nozzle 16. The treating agent is introduced into the annular groove 28 from the feed pipe 27. When the grinding disc 1 is rotating the centrifugal force will cause the treatment agent to flow outwards from the annular groove 28 through the passageway 23, 23′, and out through the nozzle 16 into the ground material which leaves the gap 4 between the discs 1.

While, as mentioned hereinbefore, at least one of the grinding discs is rotatable, both discs may be rotatable. Whichever disc is rotatable is mounted on a rotatable shaft. As is indicated in FIG. 3, the grinding discs 1, 1, are mounted for rotation on shafts 1′, 1′.

I claim:

1. Grinding apparatus which comprises a housing;

a pair of grinding discs, adjacent to and directly in front of each other, in said housing, at least one of which discs is rotatable;

the facing surfaces of which discs are capable of grinding a material;

means for supplying material to be ground to a space between the grinding discs for movement outwardly from within said space through a gap between the discs, ground material exiting therefrom into the surrounding housing; and means for the separate supply of a treating agent to the ground material said means comprising a passageway system formed in at least one of the grinding discs which is rotatable, for rotation together with said disc;

said passageway system being connected to supply openings located around and immediately outside the circumference of said gap between the grinding discs for supplying treating agent directly into the flow of grinding product upon exiting from said gap.

2. Grinding apparatus as defined in claim 1, wherein the grinding disc which is provided with the passageway system projects peripherally outside of the outlet of the grinding gap, the supply openings being provided in said projecting portion of the disc.

* * * * *